US005836616A

United States Patent [19]

Cooper

[11] Patent Number: 5,836,616

[45] Date of Patent: Nov. 17, 1998

[54] TALKING BUSINESS CARD

[76] Inventor: David S. Cooper, 627 Sharon Ct., Woodbridge, N.J. 07095

[21] Appl. No.: 833,693

[22] Filed: Apr. 8, 1997

[51] Int. Cl.[6] ..... B42D 15/00

[52] U.S. Cl. ..... 283/56; 283/75

[58] Field of Search ..... 283/72, 74, 75, 283/77, 76, 56, 99, 100

[56] References Cited

U.S. PATENT DOCUMENTS

| | | | |
|---|---|---|---|
| 4,692,601 | 9/1987 | Nakano | 283/75 X |
| 5,283,093 | 2/1994 | All | 283/75 X |
| 5,380,046 | 1/1995 | Stephens | 283/75 |

*Primary Examiner*—Willmon Fridie, Jr.
*Attorney, Agent, or Firm*—Ezra Sutton

[57] ABSTRACT

A self-contained, electronic message-emitting device in the form of a talking business card for providing a recorded message. The talking business card includes a card holding member having a base member and opposite side wall members thereon which form a first receiving channel on one side and a second receiving channel on the opposite side for slidably receiving therein the opposite sides of the business card. The base member includes a compartment for receiving an electronic message emitting assembly. The electronic message emitting assembly includes an electronic voice microchip for recording a message, a record button to initiate and activate the voice microchip to record a given message and/or sound, a play back button to play back the given message and/or sound for audio listening by the user, and a power source component for energizing the voice microchip. The business card holding member may be made of plastic or metal.

14 Claims, 4 Drawing Sheets

TALKING BUSINESS CARD

FIELD OF THE INVENTION

This invention relates to an electronic device of a talking business card having a voice and/or sound message related to the business indicia depicted on the face of the business card. More particularly, this electronic device records and plays back a personalized voice message about the business and its agent and can be listened to by a client when activating the device's self-contained electronic circuitry connected to a voice chip.

BACKGROUND OF THE INVENTION

Business cards are used throughout the world and are universally accepted to represent a company, its product(s), and its representatives or agents when initiating a first client/customer contact, at business meetings, at conventions, at society and trade organization meetings, and at social events. Presently, executives and salesmen use their business cards in conjunction with various electronic message devices such as videotapes, audio tapes, audio brochures and talking cards having a voice chip for depicting a company's product(s), celebrity or athletic stars, vacation destinations, real estate properties, and the like. They are used to indicate their advantages, usages, history, accomplishments, value, accommodations, or house locations, such that a potential client/customer can listen to and/or see the desired information needed to make an intelligent and informed choice and/or decision for that product or service.

The use of business cards to try and obtain a first meeting with the potential customer/client may take several visits to the customer's home or client's office where the salesman leaves the business card at each attempt with the office manager, receptionist or secretary. Salesmen or executives do not usually leave the aforementioned electronic message devices with the office manager, receptionist or secretary until a first meeting with the customer/client wanted to be seen (the correct decision maker) has taken place. Typically, the business card or such electronic message devices if left by the salesman do not get passed on to the customer/client decision maker and these electronic message devices and/or business cards (inexpensive) are usually thrown away without being seen or heard at a considerable expense to the company using such advertising and promotional materials. Business cards alone, or business cards accompanied by other promotional materials, as previously mentioned, do not usually get that first appointment with the decision maker needed to be seen. Every attempt at a visit by a salesman costs the company time, money, and materials which affects the profitability of the company.

There remains a need for a self-contained electronic message emitting device in the form of a talking business card having a voice and/or sound message related to the business indicia depicted on the face of the business card. The talking business card would quickly (typically in less than 120 seconds) introduce the company's product(s) or services to the customer/client in need of the product(s) or services for obtaining the first meeting between the salesman and the ultimate customer/client purchaser.

DESCRIPTION OF THE PRIOR ART

Electronic message emitting devices and the like having various designs, structures, configurations and materials of construction have been disclosed in the prior art. For example, U.S. Pat. No. 4,219,800 to Leavens discloses an electronic device having a power source, a sign with a message, and an audible reminder signal.

U.S. Pat. No. 5,359,374 to Schwartz discloses a talking picture frame having a still video image placed within a frame or plaque and also having an associated audio message stored on a recording and playback unit. The recording and playback unit is self-contained and affixed to the frame to allow for instant and repeated playback of the audio message when desired. Both the video image and the recorded message can be varied and changed according to the user's desire.

U.S. Pat. No. 5,463,369 to Lamping discloses an electronic device having a power source, a voice chip having a message, and a picture mounted on the front of the device.

U.S. Pat. No. 5,480,156 to Doederlein et al discloses a squeezable talking trading card capable of generating an audio message including a thin housing having front and back surfaces, flexible sheets having indicia affixed to the front and back surfaces of the housing, a voice chip located in the housing for generating a given message, a battery for supplying electrical power to the voice chip, and a switch located in the housing for activating a voice chip.

U.S. Pat. No. 5,588,678 to Young discloses a talking trading card having two printed trading cards attached to the top and bottom sides of a substrate in which is housed the mechanism for powering, storing, activating and emitting a recorded sound and/or message. The audio message may be pre-recorded in a voice chip or may be programmed into the voice chip after the manufacture of the talking card through a receptacle placed on the side of the talking card.

These prior art patents do not disclose or teach the use of an electronic message emitting device in the form of a talking business card. Previous attempts made in the prior art that combine visual and audio recording, show there is no unitary device which provides a portable, compact and reusable method of playing an audio message associated with a business card having indicia thereon. Also, none of the prior art patents disclose or teach the structure, configuration or design of the talking business card of the present invention.

Accordingly, it is an object of the present invention to provide a self-contained electronic message emitting device in the form of a talking business card which quickly introduces a company's product(s) or service(s) to a potential customer/client in need of that product or service.

Another object of the present invention is to provide a talking business card having a voice microchip with a recorded message for a length of time between 15 to 120 seconds in duration to briefly introduce the company, its agent and its product(s) or service(s) without the salesman or executive being present.

Another object of the present invention is to provide a talking business card having a holding member with brackets for interchangeably receiving a single business card.

Another object of the present invention is to provide a talking business card having a holding member made of a durable, lightweight plastic, metal or plasticized metal for fashionable aesthetic presentation of the talking business card in a business setting.

Another object of the present invention is to provide a talking business card that is slim, light-weight, easy to use, portable, compact, convenient, and durable.

Another object of the present invention is to provide a talking business card that is relatively inexpensive to use as a sales promotional tool for obtaining and promoting business of the card user.

A further object of the present invention is to provide a talking business card that can be mass produced in an automated and economical manner and is readily affordable as a sales promotional tool by companies or individual businessmen.

SUMMARY OF THE INVENTION

In accordance with the present invention there is provided a self-contained, electronic message-emitting device in the form of a talking business card for providing a recorded message. The talking business card includes a card holding member having a base member and opposite side wall members which form a first receiving channel on one side and a second receiving channel on the opposite side for slidably receiving therein the business card. The base member includes a holding compartment for receiving an electronic message emitting assembly. The electronic message emitting assembly includes an electronic voice microchip for recording a message, a record button to initiate and activate the voice microchip to record a given message and/or sound, a play back button to play back the given message and/or sound for audio listening by the user, and a power source component for energizing the voice microchip. The business card holding member can be made of plastic or metal.

BRIEF DESCRIPTION OF THE DRAWINGS

Further objects, features, and advantages of the present invention will become apparent upon consideration of the detailed description of the presently-preferred embodiments, when taken in conjunction with the accompanying drawings wherein.

DETAILED DESCRIPTION OF THE PREFERRED EMBODIMENT

Figure 1:
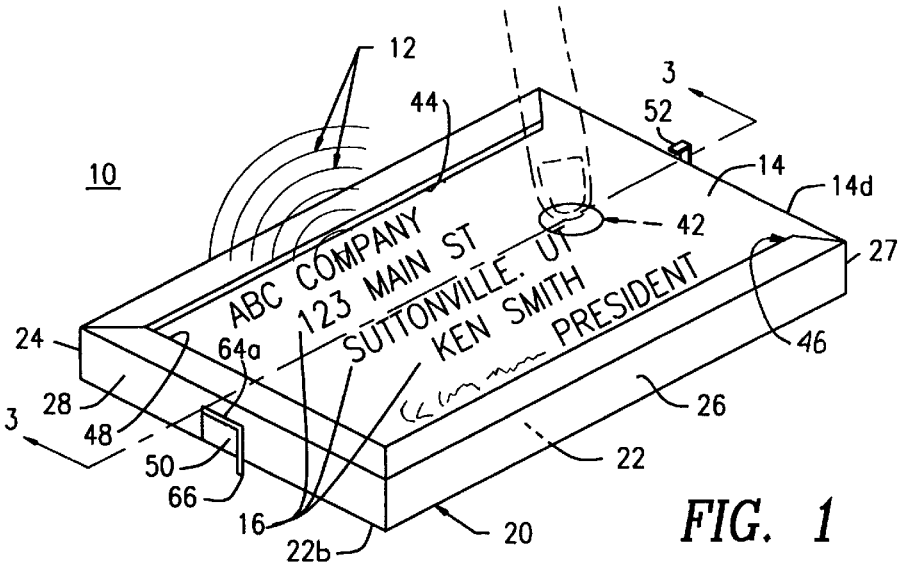
FIG. 1 is a front perspective view of the talking business card of the preferred embodiment of the present invention showing a business card in an inserted and fixed position being held by the side receiving channels of the holding member.
Figure 2:
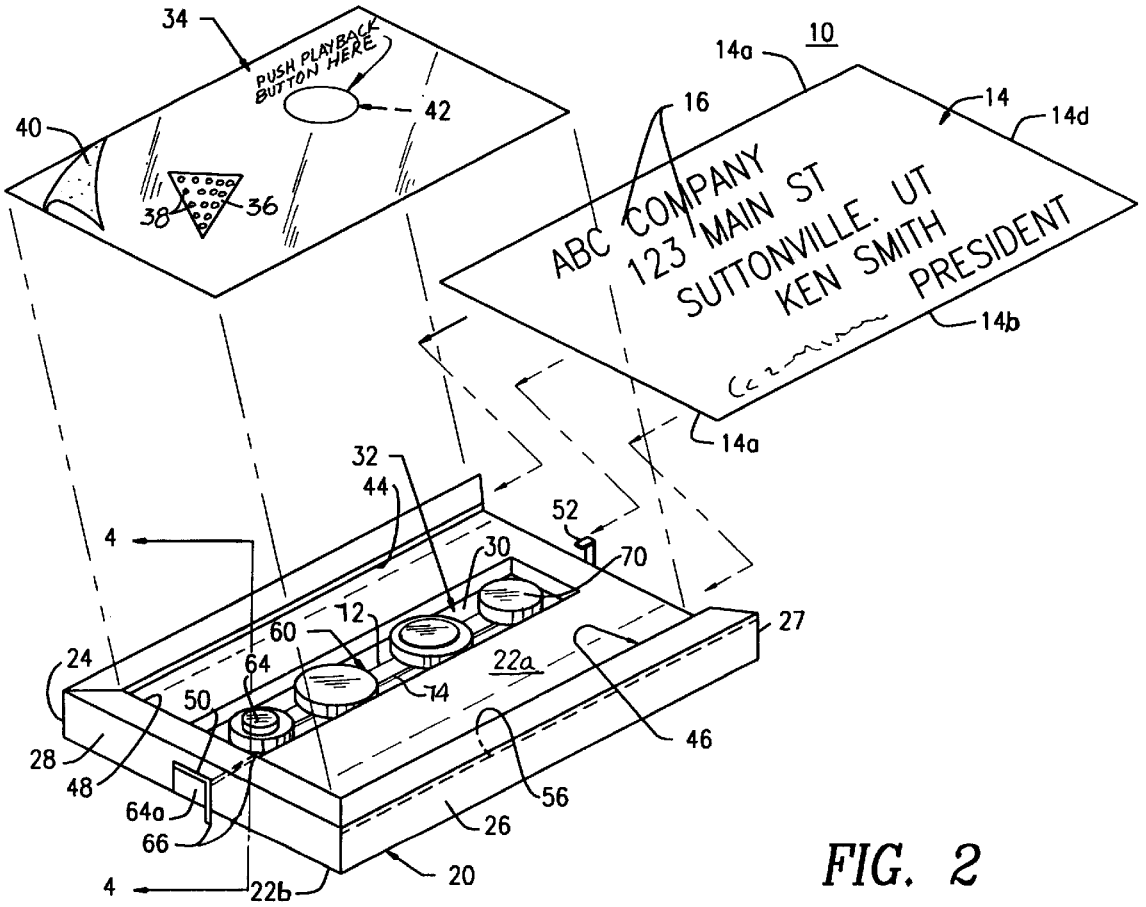
FIG. 2 is a front perspective view of the talking business card of the preferred embodiment of the present invention showing the major component parts contained therein and in operational use.
Figure 3:
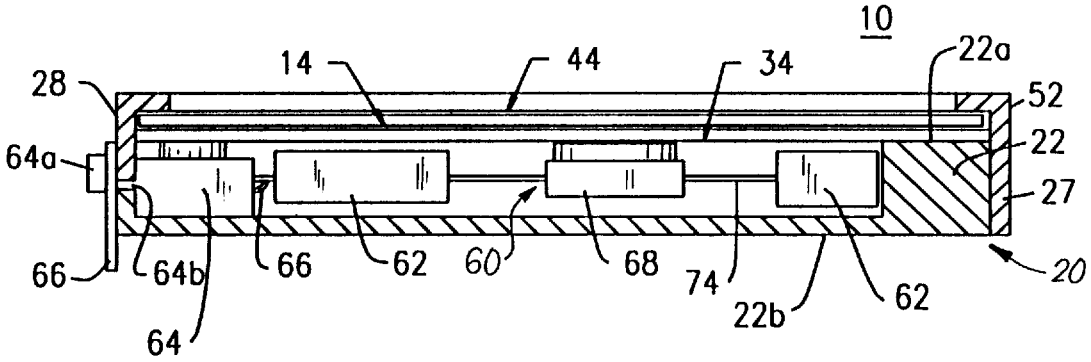
FIG. 3 is a cross-sectional view of the talking business card of the present invention taken along lines 3—3 of FIG. 1 showing the business card, the metallic foil seal, the holding compartment for receiving the voice microchip, the record button, the play back button, the microbattery power source and the holding member.
Figure 4:
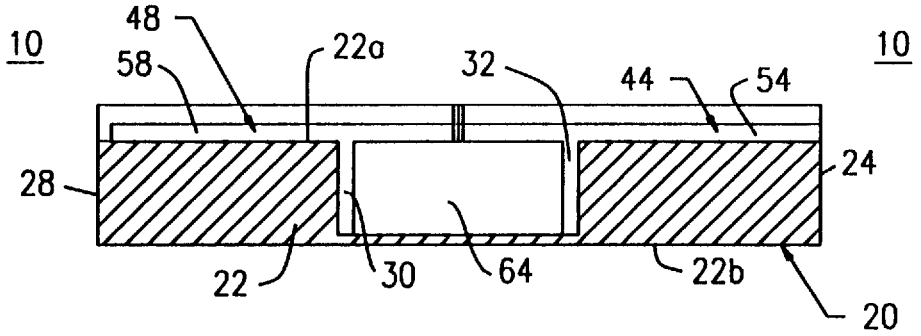
FIG. 4 is a cross-sectional view of the talking business card of the present invention taken along lines 4—4 of FIG. 2 showing the holding compartment, the side receiving channels, and the record button.

A self-contained electronic message emitting device in the form of a talking business or personal card 10 of the preferred embodiment of the present invention is represented in detail by FIGS. 1 through 7 of the drawings. As shown in FIG. 2, the talking business card 10 and its component parts are used for recording and playing back of a personalized voice message 12 about a particular business as represented on the face of business card 14 having printed indicia 16 thereon. The talking business card 10 includes a holding member 20 having a base member 22, opposite side wall members 24 and 26, a front wall member 27, and a retaining stop wall member 28. Base member 22 includes an elongated U-shaped channel 30 for forming a receiving compartment 32 to hold in place the electronic message emitting assembly 60. Base member 22 also has an inner top surface wall 22*a* and an outer bottom surface wall 22*b*. Base member 22 further includes a metallic foil cover (film) 34 having a triangle shaped section 36 with a plurality of hole openings 38 for listening to the recorded message 12. The metallic foil cover (film) 34 further includes an adhesive bottom side 40 for attaching to the top surface wall 22*a* of base member 22 and for covering the receiving compartment 32 having the electronic message emitting assembly 60 therein. Metallic cover 34 also includes a designated circular area 42 for pressing the play back button 68 of the electronic message emitting assembly 60.

Side wall members 24 and 26 include first and second side receiving channels 44 and 46, respectively, for slidably receiving therein the side perimeter edges 14*a* and 14*b* of a single business card 14. Retaining stop wall member 28 includes a third receiving channel 48 for receiving and holding one end perimeter edge 14*c* of business card 14 in place. Each receiving channel 44 and 46 includes a rear channel wall 54 and 56, respectively, for receipt and contact with each perimeter edge 14*a* and 14*b* of business card 14 within holding member 20; and receiving channel 48 includes a rear channel wall 58 for receipt and contact with perimeter edge 14*c* of business card 14 within holding member 20. Retaining stop wall member 28 further includes a rectangular opening 50 for receiving of the button plate 64*a* of record button 64 of the electronic message emitting assembly 60.

Front wall member 27 includes an L-shaped retaining stop tab 52 being integrally connected and centrally located on front wall member 27. Retaining stop tab 52 prevents the unintentional removal of the business card 14 after insertion of the business card 14 within the first, second and third receiving channels 44, 46 and 48, as depicted in FIG. 1 of the drawings. After insertion, the perimeter edge 14*d* of business card 14 is in direct contact with retaining stop tab 52.

The electronic message emitting assembly 60, as shown in FIGS. 2, 3, 6, and 7, includes an electronic voice microchip 62 for recording a message 12, a record button 64 to initiate and activate the voice microchip 62 to record a given message 12 and/or sound 12, a tear-off tab 66 which inactivates the record button 64 after acceptance by the user of the recorded message 12, a play back button 68 to play back the given message 12 and/or sound 12 for audio listening by the user, and a microbattery power source 70 for energizing the electronic voice microchip 62. In addition, record button 64 includes a button plate 64*a* having pins 64*b* which engage record button 64 to make electrical contact therewith and actuate the recording process. All electronic component parts 62, 64, 68 and 70 of the electronic message emitting assembly 60 are interconnected with positive and negative electrical lines 72 and 74, respectively. Voice microchip 62 is capable of retaining a recorded message having a 15 second to 120 second length of time duration.

The physical dimensions of the talking business card 10 are as follows: The card holding member 20 measurements are that the base member 22 has a width of fifty-five millimeters (55 mm) and a length of ninety-five millimeters (95 mm) ; side wall members 24 and 26 have a height of six millimeters (6 mm) and a length of ninety-five millimeters (95 mm); and the stop wall member 28 has a height of six millimeters (6 mm) and a width of fifty-five millimeters (55 mm) The holding compartment 32 has a width of twenty millimeters (20 mm), a length of eighty millimeters (80 mm) and a depth of four millimeters (4 mm) for holding in place the electronic message emitting assembly 60. The metallic foil cover 34 has a width of thirty-five millimeters (35 mm), a length of eighty-five millimeters (85 mm), and a foil thickness of 5 mils for covering the holding compartment 32 for physically protecting the electronic message emitting assembly 60 from damage. It should be noted a standard business card in the U.S. measures fifty millimeters (50mm) in width and ninety millimeters (90 mm) in length by one mil (1 mil) in thickness.

OPERATION OF THE PRESENT INVENTION

Figure 5:
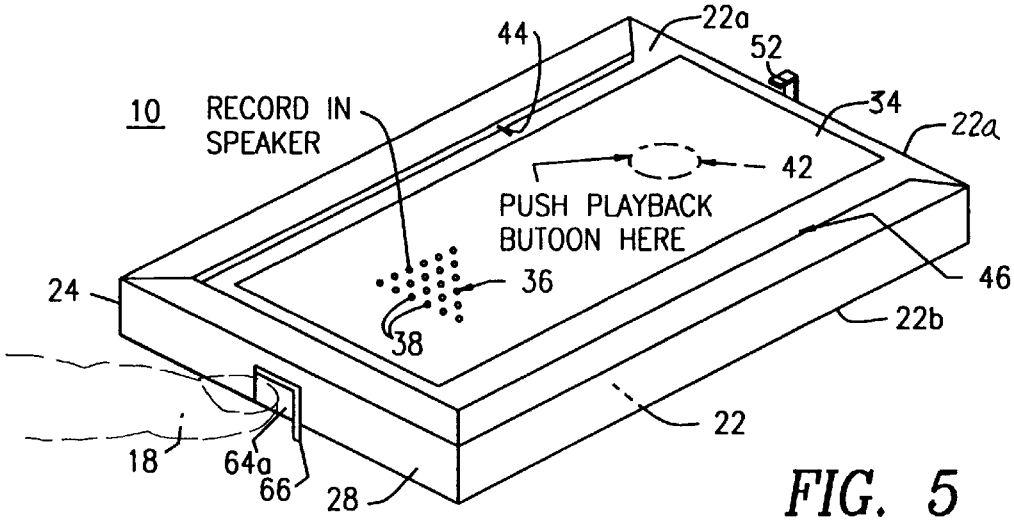
FIG. 5 is a front perspective view of the talking business card of the present invention showing the holding member and the electronic message emitting assembly in operational use by the user prior to the business card insertion.
Figure 6:
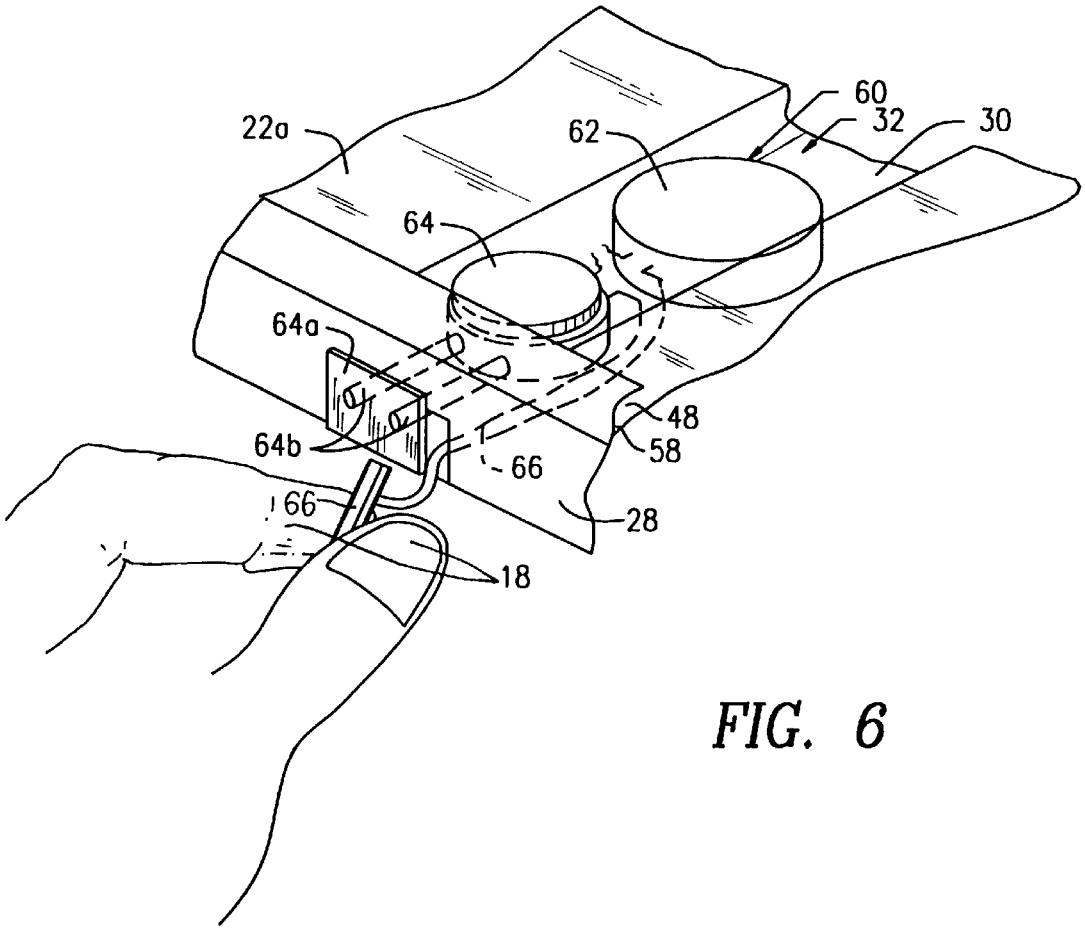
FIG. 6 is an enlarged partial perspective view of the talking business card of the present invention showing the voice microchip, the record button with an interrupt stop tab and the retaining stop wall member of the holding member in operational use to stop any further recording of a message.
Figure 7:
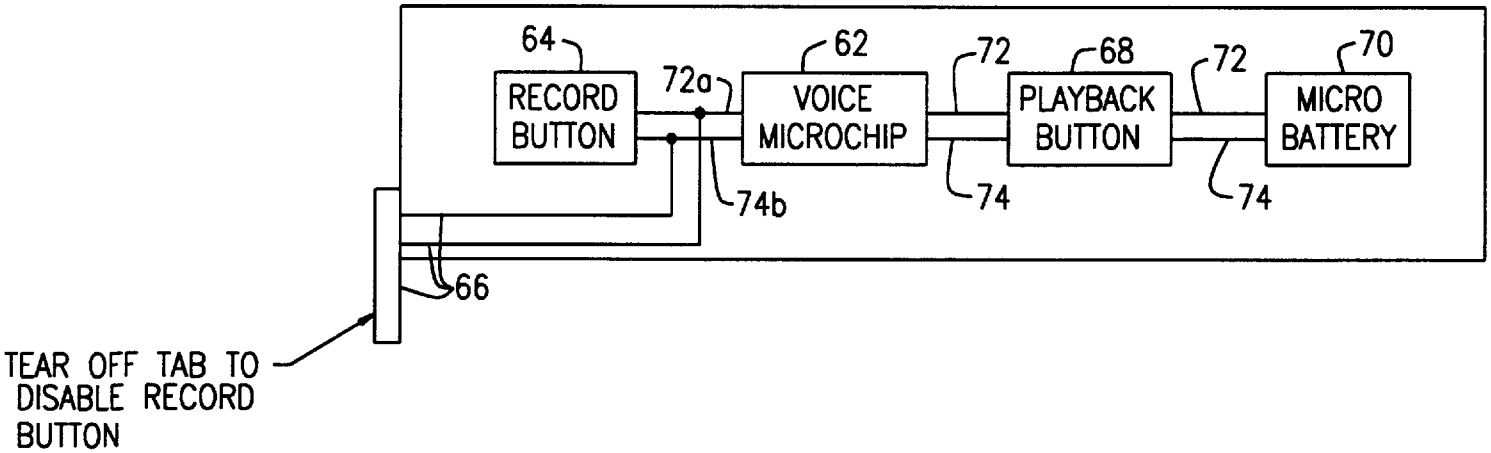
FIG. 7 is an electrical schematic diagram of the talking business card of the present invention showing the electrical circuit of the electronic message emitting assembly thereof.

In operation, the executive or salesman or company representative initiates the first use of the talking business card 10 of the present invention by recording a personalized voice message 12 about the business, its agents, and/or product(s) or service(s). To start this process of recording the personalized voice message 12, as shown in FIG. 5 of the drawings, the user by his or her thumb/finger 18 depresses inwardly the record button 64 located on stop wall member 28 which activates the voice microchip 62. This action by the user starts the process of voice or sound recording by the voice microchip 62, such the user speaks into the triangle shaped section 36 having openings 38 within metallic cover film 34. Triangle shaped section 36 is directly above voice microchip 62. The user then proceeds to give a 15 second to 120 second in duration business message 12 which briefly introduces the company, its agent, its product(s) or service (s). At the end of recording the aforementioned personalized voice business message 12, then the user uses his or her thumb/finger 18 depress the designated circular area 42 on metallic cover film 34 which activates the play back button 68 allowing the user to listen to the audio message 12 first recorded. Designated circular area 42 is directly above play back button 68, as shown in FIGS. 2 and 5 of the drawings. If the user does not like the above mentioned voice recorded message 12, the user has the opportunity to re-record a new, improved, corrected voice message 12' by the user depressing the record button 64 again and repeating the aforementioned procedure again. This aforementioned procedure can be repeated as many times as the user desires, until he or she feels the voice message is correct. Once the user is satisfied with the recorded message, the user breaks off the tear-off tab 66 from record button 64 which now prevents any further recording of another voice message 12 on the electronic voice microchip 62. The tear-off tab 66 when removed disconnects and interrupts electrical lines 72*a* and 74*a* that were directly connected to the electronic voice microchip 62, as shown in FIG. 7 of the drawings. This last procedure sets the talking business card 10 to a particular given message 12 to which a potential customer or client will be able to listen to.

The user then proceeds to insert his or her business card 14 having printed indicia 16 thereon into the card holding member 20 such that the perimeter edges 14*a* and 14*b* of business card 14 slidably enter into the first and second side-receiving channels 44 and 46 on side wall members 24 and 26. The perimeter edges 14*a* and 14*b* of business card 14 will be adjacent to and in contact with rear channel walls 54 and 56 of each receiving channel 44 and 46 to hold the business card 14 in place within holding member 20. The perimeter edge 14*c* of business card 14 is then received within receiving channel 48 of stop wall member 28 such that the perimeter edge 14*c* of business card 14 is adjacent to and in contact with rear channel wall 58. Business card 14 is in contact with the rear channel wall 58 which now prevents the business card 14 from moving out of the card holding member 20, as shown in FIG. 1 of the drawing. In addition, after insertion of the business card 14 within the first, second and third side-receiving channels 44, 46 and 48, perimeter edge 14*d* of business card 14 is in direct contact with retaining stop tab 52. After insertion of the business card 14 by the user, stop tab 52 prevents any unintentional removal of the business card 14 from the base member 22 of holding member 20.

With the business card 14 in place within card holding member 20, the salesman or the company's representative is now ready to present the talking business card 10 to the potential client/customer who may be interested in buying or using the company's product(s) and/or service(s). In presenting the talking business card 10 to the potential client/customer or their representative (receptionist, secretary, office manager, etc.), the salesman would then show the area 42 on the printed face 16 of the business card 14 for pushing the playback button 68 in order to listen to the recorded business message 12 provided by the company's representative. The personalized business message 12 can be listened to many times until the source of energy within microbattery power source 70 has been completely depleted.

ADVANTAGES OF THE PRESENT INVENTION

Accordingly, an advantage of the present invention is that it provides for a self-contained electronic message emitting device in the form of a talking business card which quickly introduces a company's product(s) or service(s) to a potential customer/client in need of that product or service.

Another advantage of the present invention is that it provides for a talking business card having a voice microchip with a recorded message for a length of time between 15 to 120 seconds in duration to briefly introduce the company, its agent and its product(s) or service(s) without the salesman or executive being present.

Another advantage of the present invention is that it provides for a talking business card having a holding member with brackets for interchangeably receiving a single business card.

Another advantage of the present invention is that it provides for a talking business card having a holding member made of a durable, lightweight plastic, metal or plasticized metal for fashionable aesthetic presentation of the talking business card in a business setting.

Another advantage of the present invention is that it provides for a talking business card that is slim, lightweight, easy to use, portable, compact, convenient, and durable.

Another advantage of the present invention is that it provides for a talking business card that is relatively inexpensive to use as a sales promotional tool for obtaining and promoting business of the card user.

A further advantage of the present invention is that it provides for a talking business card that can be mass produced in an automated and economical manner and is readily affordable as a sales promotional tool by companies or individual businessmen.

A latitude of modification, change, and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. A self-contained, electronic message-emitting device in the form of a talking business card for providing a recorded message, comprising:

a) a card holding member including a base member and opposite side wall members thereon which form a first receiving channel on one side and a second receiving channel on the opposite side for slidably receiving therein the opposite edges of a business card;

b) said base member including a compartment for receiving an electronic message emitting assembly; and c) said electronic message emitting assembly including an electronic voice microchip for recording a message or sound, a record button to initiate and activate said voice microchip to record said message or sound, a play back button to play back said message or sound for audio listening by the user, and a power source component for energizing said voice microchip.

2. A talking business card in accordance with claim 1, further including a metallic foil cover for covering said compartment having said electronic message emitting assembly therein.

3. A talking business card in accordance with claim 2, wherein said metallic foil cover includes a designated area having a plurality of small hole openings for passing through said message or sound to said voice microchip.

4. A talking business card in accordance with claim 2, wherein said metallic foil cover includes a designated area for indicating the location of said play back button to play back said message or sound for audio listening when pushed by the user.

5. A talking business card in accordance with claim 1, wherein said card holding member is made of a material selected from the group consisting of durable plastic, steel, stainless steel and aluminum.

6. A talking business card in accordance with claim 5, wherein said card holding member is molded or stamped from said materials selected from the group consisting of durable plastic, steel, stainless steel and aluminum.

7. A talking business card in accordance with claim 1, wherein said card holding member further includes a retaining stop wall member having a third receiving channel to stop the forward movement of the business card after insertion into said first and second receiving channels.

8. A talking business card in accordance with claim 7, wherein said card holding member further includes a retaining stop tab to prevent the unintentional removal of the business card after insertion into said first, second and third channels.

9. A talking business card in accordance with claim 1, wherein said voice microchip has a 15 second to 120 second length of time duration for retaining a recorded message therein.

10. A talking business card in accordance with claim 1, wherein said power source component is a microbattery.

11. A talking business card in accordance with claim 1, wherein said record button includes a removable component associated with said record button for inactivating said voice microchip from further recordings.

12. A talking business card in accordance with claim 1, wherein said card holding member for holding in place a business card therein has a width measurement of fifty-five millimeters (55 mm), a length measurement of ninety-five millimeters (95 mm), and a height measurement of six millimeters (6 mm).

13. A talking business card in accordance with claim 1, wherein said compartment for receiving said electronic message emitting assembly therein has a width measurement of twenty millimeters (20 mm), a length measurement of eighty millimeters (80 mm) and a depth measurement of four millimeters (4 mm).

14. A talking business card in accordance with claim 2, wherein said metallic foil cover for covering over said compartment has a width measurement of thirty-five millimeters (35 mm), a length measurement of eighty-five (85 mm) and thickness measurement of five mils (5 mil).

* * * * *